US006811252B2

(12) United States Patent
Speich

(10) Patent No.: US 6,811,252 B2
(45) Date of Patent: Nov. 2, 2004

(54) INSTALLATION FOR CONTINUOUSLY PRODUCING AN IMPRINTED TEXTILE STRIP, ESPECIALLY A LABEL STRIP

(75) Inventor: Francisco Speich, Gipf-Oberfrick (CH)

(73) Assignee: Textilma AG (CH)

( * ) Notice: Subject to any disclaimer, the term of this patent is extended or adjusted under 35 U.S.C. 154(b) by 0 days.

(21) Appl. No.: 10/332,560

(22) PCT Filed: May 29, 2001

(86) PCT No.: PCT/CH01/00332

§ 371 (c)(1),
(2), (4) Date: Mar. 26, 2003

(87) PCT Pub. No.: WO02/11988

PCT Pub. Date: Feb. 14, 2002

(65) Prior Publication Data

US 2003/0161673 A1 Aug. 28, 2003

(30) Foreign Application Priority Data

Jul. 11, 2000 (CH) ..... 1367/00

(51) Int. Cl.[7] ..... B41J 2/01

(52) U.S. Cl. ..... 347/104; 400/621; 101/483; 101/489; 101/222

(58) Field of Search ..... 347/16, 37, 35, 347/40, 43, 24, 101, 102, 104; 400/621; 101/222, 223, 230, 483, 489; 355/244, 319

(56) References Cited

U.S. PATENT DOCUMENTS

| | | | | |
|---|---|---|---|---|
| 4,033,521 A | | 7/1977 | Dee | |
| 4,610,198 A | * | 9/1986 | Raymond | 101/223 |
| 5,079,980 A | | 1/1992 | Oakes et al. | |
| 5,467,179 A | * | 11/1995 | Boeck et al. | 101/223 |
| 5,546,178 A | | 8/1996 | Manzer et al. | |
| 5,568,245 A | * | 10/1996 | Ferber et al. | 101/223 |
| 5,854,647 A | * | 12/1998 | Ohtsuka | 347/101 |
| 5,997,129 A | * | 12/1999 | Matsuhashi | 347/35 |
| 6,120,142 A | | 9/2000 | Eltgen et al. | |
| 6,236,816 B1 | * | 5/2001 | Warbus et al. | 399/46 |
| 6,267,518 B1 | * | 7/2001 | Abe | 347/3 |
| 6,428,159 B1 | * | 8/2002 | Roy et al. | 347/102 |

FOREIGN PATENT DOCUMENTS

| | | |
|---|---|---|
| DE | 26 24 055 A | 5/1997 |
| DE | 694 06 638 A | 5/1997 |
| EP | 0 532 645 B1 | 12/1991 |
| EP | 0 659 569 B1 | 12/1994 |
| EP | 0 790 347 A | 8/1997 |
| EP | 0 835 761 A2 | 4/1998 |
| JP | 04339679 A | 11/1992 |
| JP | 05238073 A | 9/1993 |

OTHER PUBLICATIONS

IBM Technical Disclosure Bulletin "Two Path Elected Photograpic Print Process" Nov. 1979, vol. 22, No. 6, 2465–2466.

* cited by examiner

*Primary Examiner*—Eugene H. Eickholt
(74) *Attorney, Agent, or Firm*—George Pappas

(57) ABSTRACT

The inventive installation for continuously producing and imprinted textile strip (24, 24A, 24B, 24C, 26, 26A, 26B) contains a print station (12) that is connected to an electronic control device (66). In order to achieve a cost savings and an efficient production of the imprinted textile strip, the inventive installation is configured in such a manner that a print head (28) of the print station (12) imprints a first strip side (27) of the textile strip (24, 26). Alternatively, the second strip side (40) of the textile strip can be additionally imprinted during a working operation involving the use the same print head (28) and the same printing station.

23 Claims, 6 Drawing Sheets

INSTALLATION FOR CONTINUOUSLY PRODUCING AN IMPRINTED TEXTILE STRIP, ESPECIALLY A LABEL STRIP

TECHNICAL FIELD

The invention relates to a plant for the continuous production of a printed textile tape, in particular a label tape.

PRIOR ART

Many plants of the type initially mentioned are known, as, for example, from EP-B 0 532 645 and U.S. Pat. No. 5,079,980. Particularly from the latter, it is known to print a textile tape on two sides, the plant [sic] being supplied to a first printing station for printing the first tape side and to a second printing station for printing the second tape side of the textile tape. By two printing stations being arranged, each with a printing head, the plant is relatively costly, since the printing heads also belong to the costly components of the plant, with the result that the printing of the textile tape is correspondingly costly, this being a disadvantage for mass products, such as label tapes.

PRESENTATION OF THE INVENTION

The object of the invention is to improve a plant of the type initially mentioned, in such a way that a cost-effective production of printed textile tapes, in particular label tapes, is possible.

Since the plant is designed in such a way that it can print not only one tape side of the textile tape, but selectively also the second tape side of the textile tape by means of the same printing head, a highly cost-effective plant is obtained, which allows a cost-effective production of printed textile tapes, this being particularly important especially for label tapes.

It is particularly advantageous when, the printing head a check sensor which checks the print to be produced and, in the event of a fault, transmits a fault signal to the control device in order to stop the plant. Such a faulty print may occur, for example, when, in the case of an ink-jet printer, individual printer nozzles fail and therefore do not print.

The printing of the first and second tapes sides of the textile tape, although taking place in one operation, is preferably phase-shifted since, after the printing of the first tape side, the textile tape has to be supplied with the second tape side to the printing station again. In this case, the second tape side of the textile tape can be moved past the printing head in the same running direction as the first tape side or, in the opposite running direction to the first tape side. In order to implement this renewed supply of the textile tape, the plant contains a turning station which may be designed in very different ways. Thus, the turning station may have a device for turning the textile tape about a longitudinal axis of the textile tape. It is also possible to have a turning station which makes it possible to turn the textile tape about a transverse axis. For this purpose, the turning station may have a turning member arranged transversely to the running direction. An embodiment of the plant is particularly preferred, the turning station having deflecting rollers which are arranged crosswise and which allow a particularly exact orientation of the textile tape with respect to the printing station.

There are very varied possibilities for the design of the printing station, depending on which printing method is employed and whether single-color or multicolor printing is carried out. In this context, only printing machines which allow electronic data processing and operate at a correspondingly high speed come under consideration. An ink-jet printer is particularly preferred, which may be of single-color or multicolor design and in which the individual characters are composed in a mosaic-like manner from very fine jet droplets. This also makes it possible, in particular, to have a relatively small printing head which, can be designed to move back and forth transversely over the textile web [sic]. Such an ink-jet printer may be designed for the processing of water-based printing inks. An embodiment for the processing of printing inks polymerizing by UV light is more advantageous.

It is also particularly advantageous to have an embodiment of the printing station a laser printer, in which a laser beam controlled in direction in a programmed manner writes the characters onto an electrostatically precharged semiconductor photo film. The charge image which occurs is transferred with the aid of toner particles from the printing drum covered with the film onto the textile tape.

In the simplest instance, the printing station can print in one color, but an embodiment as a multicolor printer is also more advantageous.

The printing station is followed by at least one fixing station for the print. The design of the fixing station depends on the printing principle used.

In this case, it is necessary, in particular, to ensure that fixing takes place as quickly as possible and that the print is as resistant as possible. In particular, a fixing station based on UV light is suitable for polymerizing printing inks. For laser printers operating with toner, it is preferable to have an IR fixing station which delivers the necessary heat for fusing the toner particles on the textile tape. In the latter instance, it is advantageous to have an additional press station, which imprints the print into the textile tape and thus improves the bond.

It is advantageous, further, that the plant has a tape fixing station for the printed textile tape, in order to free the textile tape of stresses and smooth it.

An embodiment of the plant is particularly advantageous, whereby the printing station is followed by a coating station, in order to provide the printed textile tape with a protective layer. Such a protective layer protects the print on the textile tape against mechanical and chemical stress.

A design of the plant is particularly advantageous, making it possible to process a textile web, the width of which is preferably larger by a multiple than the width of the textile tape to be printed. Consequently, the initial material can be an efficiently produced wide textile web, from which printed textile tapes of the desired width can then be produced. Various possibilities are afforded for this purpose. A particularly advantageous embodiment of the plant which is suitable particularly for larger batches of printed textile tapes. An embodiment of the plant is particularly suitable for smaller batches, in which case the textile tape of desired width which is to be printed can be cut off from a stock roll of larger width and printed. The rest of the textile web is then supplied again to a reception device, preferably a reception roll.

The production capacity of a plant can also be further increased in that, the printing station is designed in such a way that at least two longitudinal strips can be printed on the textile tape, the printing station being followed by a longitudinal-cutting station, in order to cut the textile tape into textile tapes corresponding to the printed longitudinal strips.

To improve the quality of the printed textile tapes produced, the plant may be provided with a folding station, in order to fold the edge regions of the printed textile tape against one another and thereby place an ugly or rough cut edge away from the edge region toward the inside. The fold can be fixed permanently by means of a fixing station following the folding station.

The printed textile tape can either be rolled up or be deposited in a tangled state in a container. It is more advantageous, however, to have a design of the plant whereby there is a cross-cutting station, in order to subdivide the printed textile tape into portions. This cross-cutting station may advantageously be followed by a stacking device, in order to pick up the textile tape portions in ordered form.

BRIEF DESCRIPTION OF THE DRAWINGS

Exemplary embodiments of the invention are described in more detail below with reference to diagrammatic drawings in which.

WAYS OF IMPLEMENTING THE INVENTION

Figure 1:
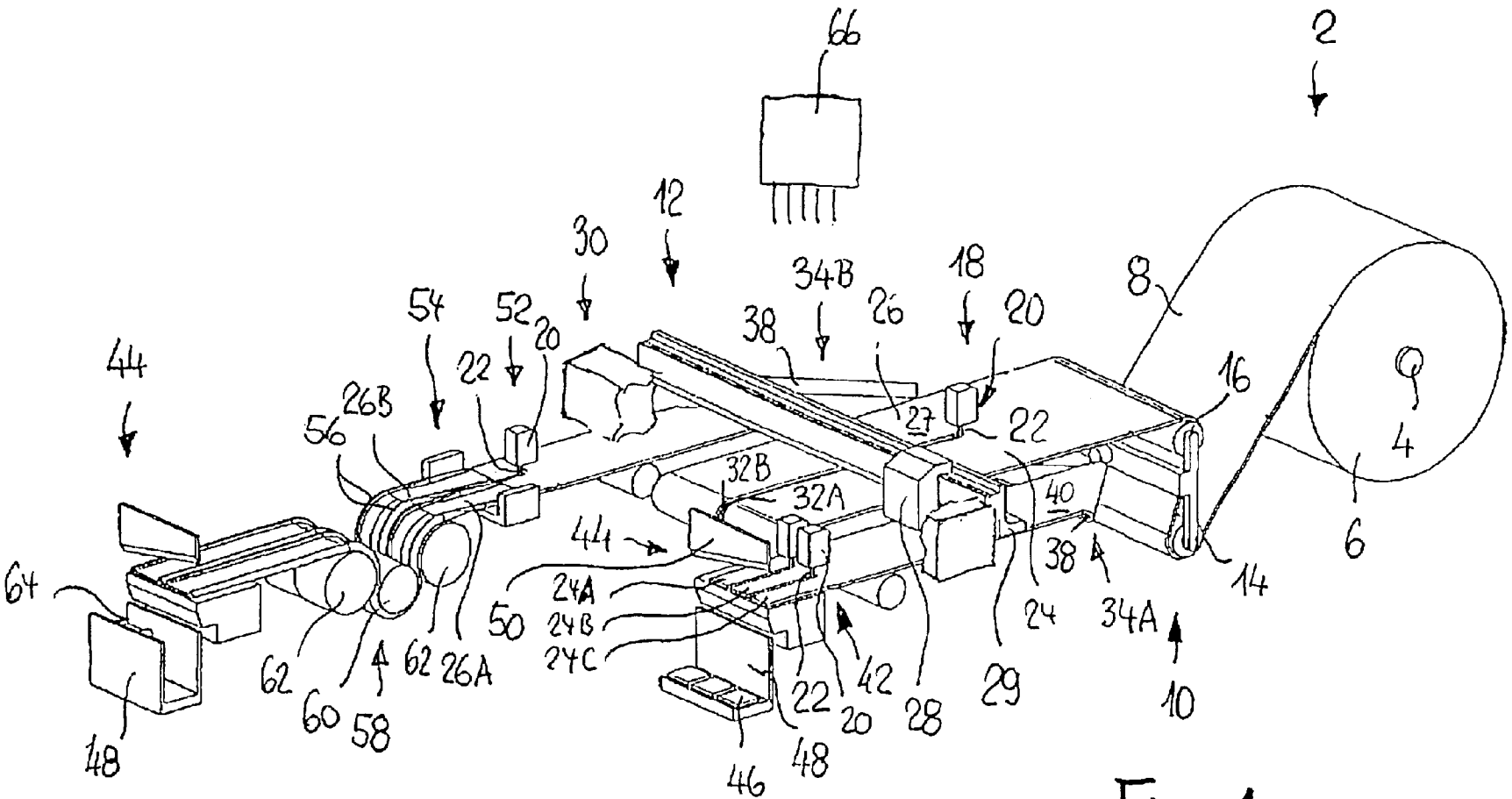
FIG. 1 shows a diagrammatic illustration of a first plant for the continuous production of a printed textile tape, in particular a label tape.
Figure 2:
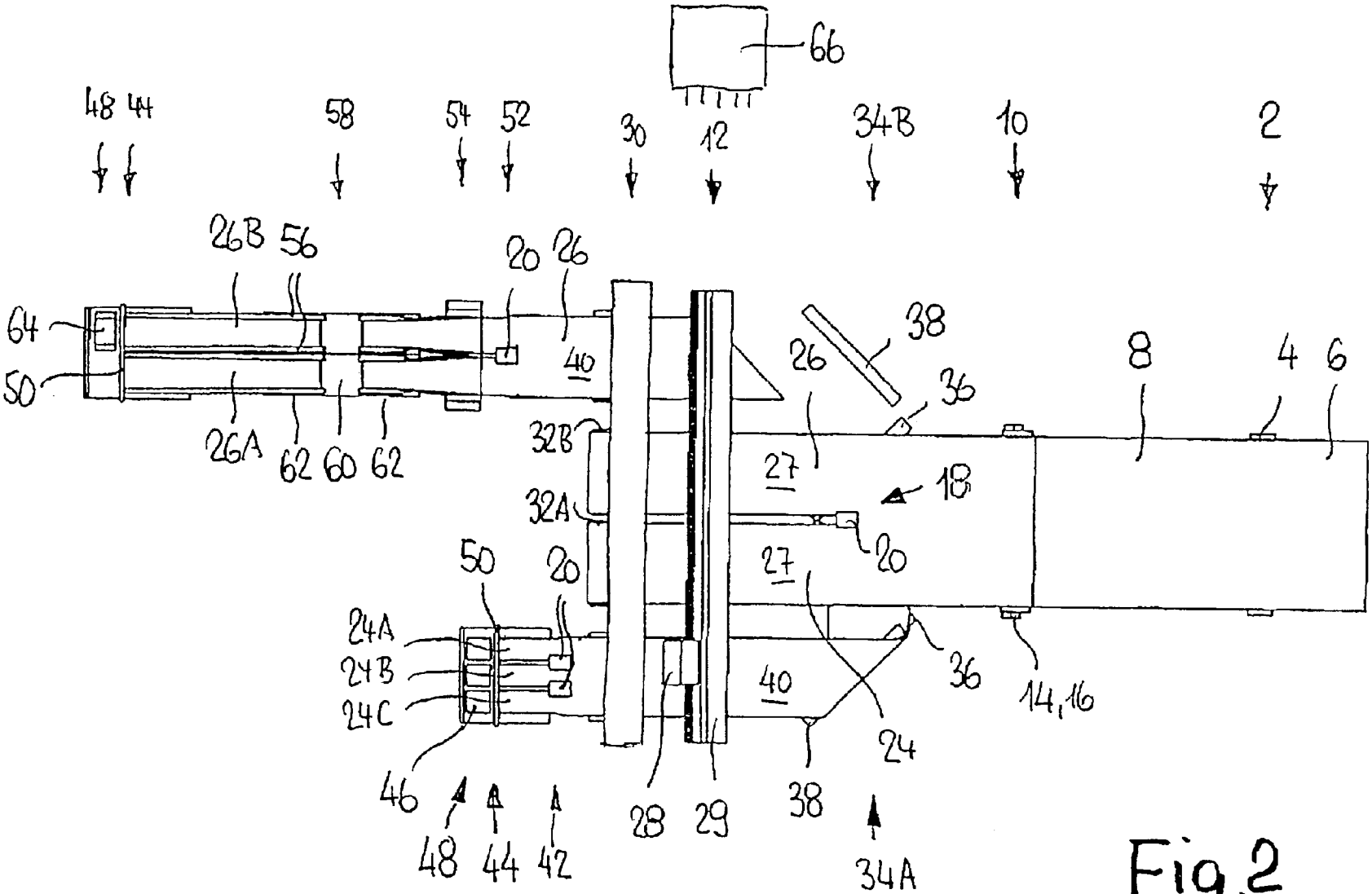
FIG. 2 shows a plan view of the plant of FIG. 1.
Figure 3:
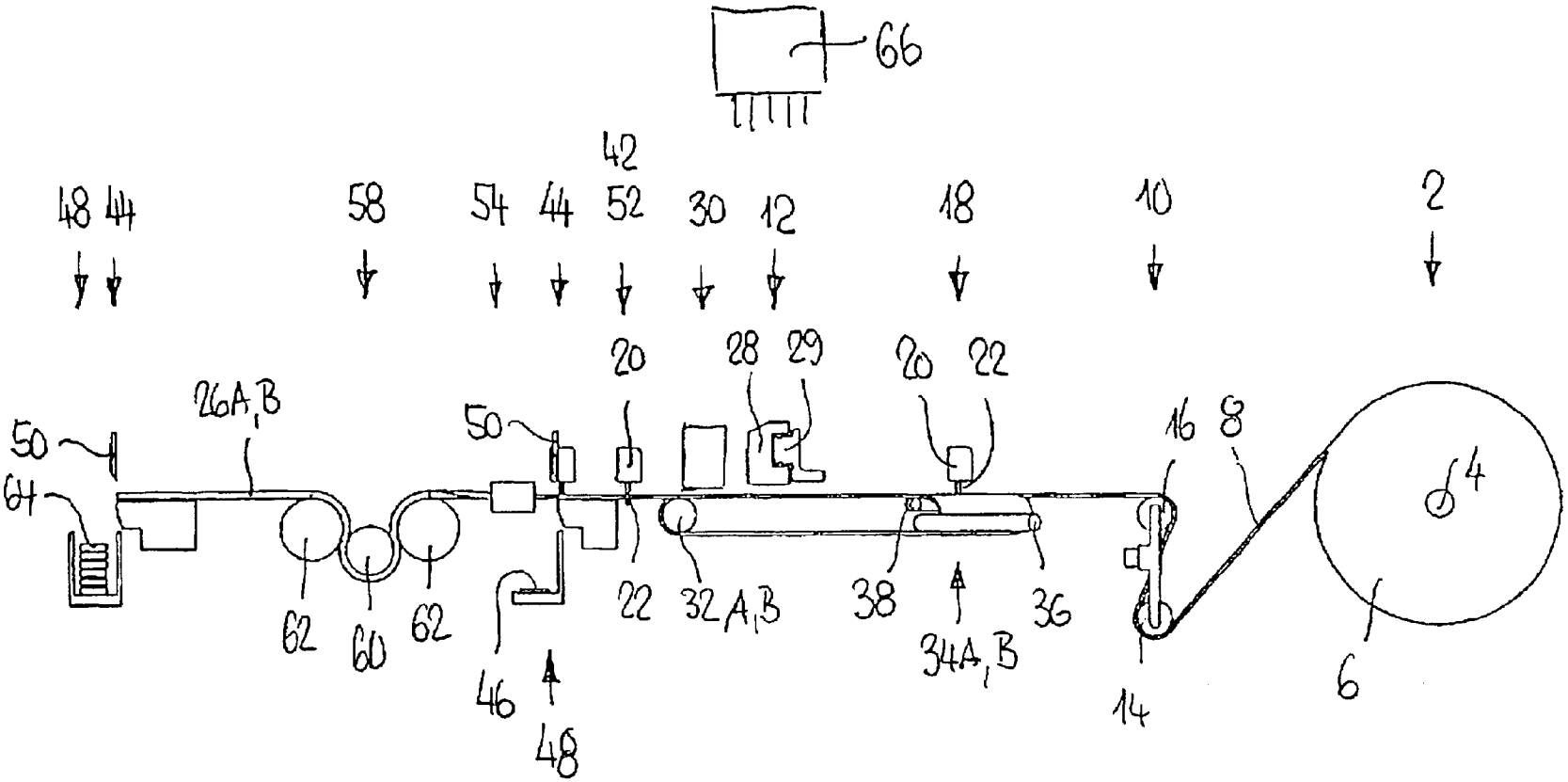
FIG. 3 shows a side view of the plant of FIG. 1.

FIGS. 1 to 3 show a first plant for the continuous production of a printed textile tape, in particular a label tape. The plant has a delivery device 2, in which a stock roll 6 of a textile web 8 is arranged on a shaft 4. The textile web 8 is led via a straightening device 10 to a printing station 12. The straightening device 10 contains two rollers 14, 16, over which the textile web 8 is led in a meander-shaped manner. The straightening device 10 serves for holding the textile web 8 constantly in an exact position with respect to the printing station 12. Arranged upstream of the printing station 12 is a first longitudinal-cutting station 18 which subdivides the textile web 8 into two textile tapes 24, 26 by means of a cutting element 20, for example in the form of an electrically heated fuse wire 22. These textile tapes run with a first tape side 27 through a common printing station 12 with a printing head 28 which is moveable back and forth transversely to the textile tapes 24, 26 along a bearer 29. The printing head 28 is designed preferably as an ink-jet printer which prints the textile tapes 24, 26 with a polymerizable ink. The printing station 12 is followed by a fixing station 30 which fixes the print by polymerization by means of UV light. The textile tapes 24, 26 are supplied to turning stations 34A, 34B by means of deflecting rollers 32A, 32B.

The turning stations contain turning members 36, 38, for example bars or rollers, which are arranged crosswise. At the first turning member 36, the textile tapes 24 or 26 are first deflected through 90° toward the second turning member 38 and are led back at the latter, again through 90°, parallel to the textile web 8 of the printing station 12, so that the textile tapes 24 or 26 run through the printing station 12 with a second tape side 40 in the opposite direction to the first tape side 27. The second tape side 40 is then printed in one operation at the same printing station 12 by means of the same printing head 28, the print of the second tape side 40 being phase-shifted with respect to the print of the first tape side 27. The second tape side 40 is then likewise supplied to the same fixing station 30 which also serves for fixing the print of the first tape side.

After the printing of the first tape side 27 and second tape side 40 of the textile tapes 24, 26, these can be further processed as desired. In the simplest instance, the textile tapes 24, 26 can be rolled up on stock rolls or be subdivided into portions in a way not illustrated. FIGS. 1 to 3 show further processing possibilities, thus, downstream of the fixing device 30, the textile tape 24 is once again subdivided at a second longitudinal-cutting station 42 into textile tapes 24A, 24B, 24C of smaller width which are subdivided into textile tape portions 46 at a cross-cutting station 44 and stacked in a stacking device 48. The longitudinal-cutting station 42 contains cutting elements 20 designed as fuse wires 22. The cross-cutting station 44 is equipped with a cutting knife 50 moveable transversely to the running direction.

The textile tape 26 on the other side of the plant is likewise supplied to a longitudinal-cutting station 52, at which it is subdivided into two textile tapes 26A, 26B by means of a cutting element 20 in the form of an electrically heated fuse wire 22. The longitudinal-cutting station 52 is followed by a folding station 54, at which the edge regions 56 of the textile tapes 26A, 26B are folded against one another. In a following tape fixing station 58, the form of the folded tapes is fixed. For this purpose, the fixing station has a heating roller 60 and two press rollers 62 which press the folded tapes against the heating roller 60. In a following cross-cutting station 44, the textile tapes 26A, 26B thus folded are cut once more into textile tape portions 64 which are stacked in a stacking device 48.

For controlling the plant, there is an electronic control device 66 which, in particular, controls the printing station 12 together with the printing head 28 and also coordinates the remaining components of the plant with one another.

Figure 4:
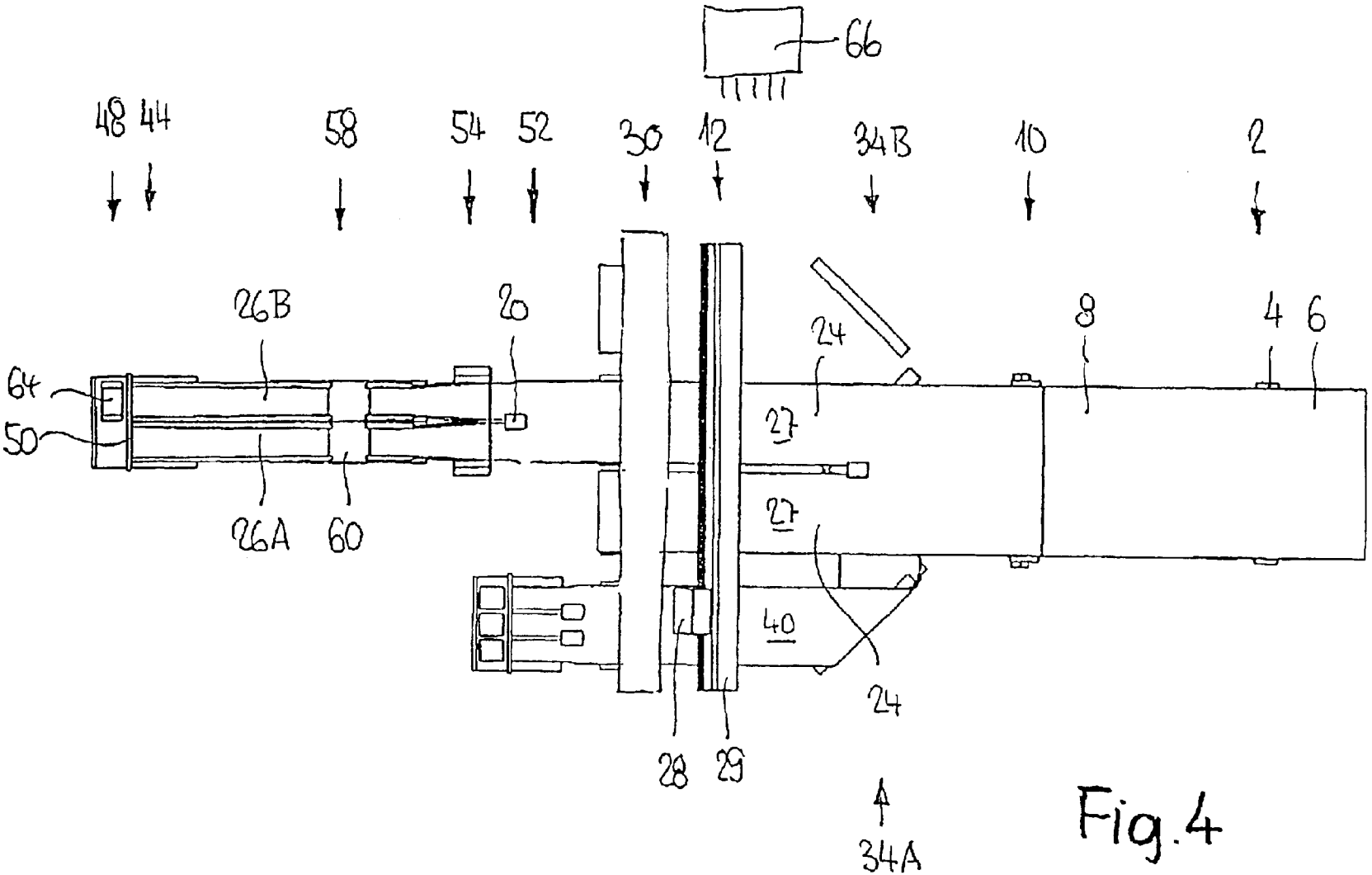
FIG. 4 shows the plant according to FIG. 2, in which, however, the textile tape is printed on only one side on one side of the plant.

FIG. 4 shows the plant of FIGS. 1 to 3, but, here, the right part of the plant downstream of the printing station 12 is displaced transversely to the running direction of the textile tape in such a way that the textile tape 26 no longer runs through the turning station 34B, but is supplied directly to the longitudinal-cutting station 52, the following folding station 54, the tape fixing station 58 and the cross-cutting station 44 and stacking device 48. In this case, only the first tape side 27 of the textile tape 26 is printed.

Figure 5:
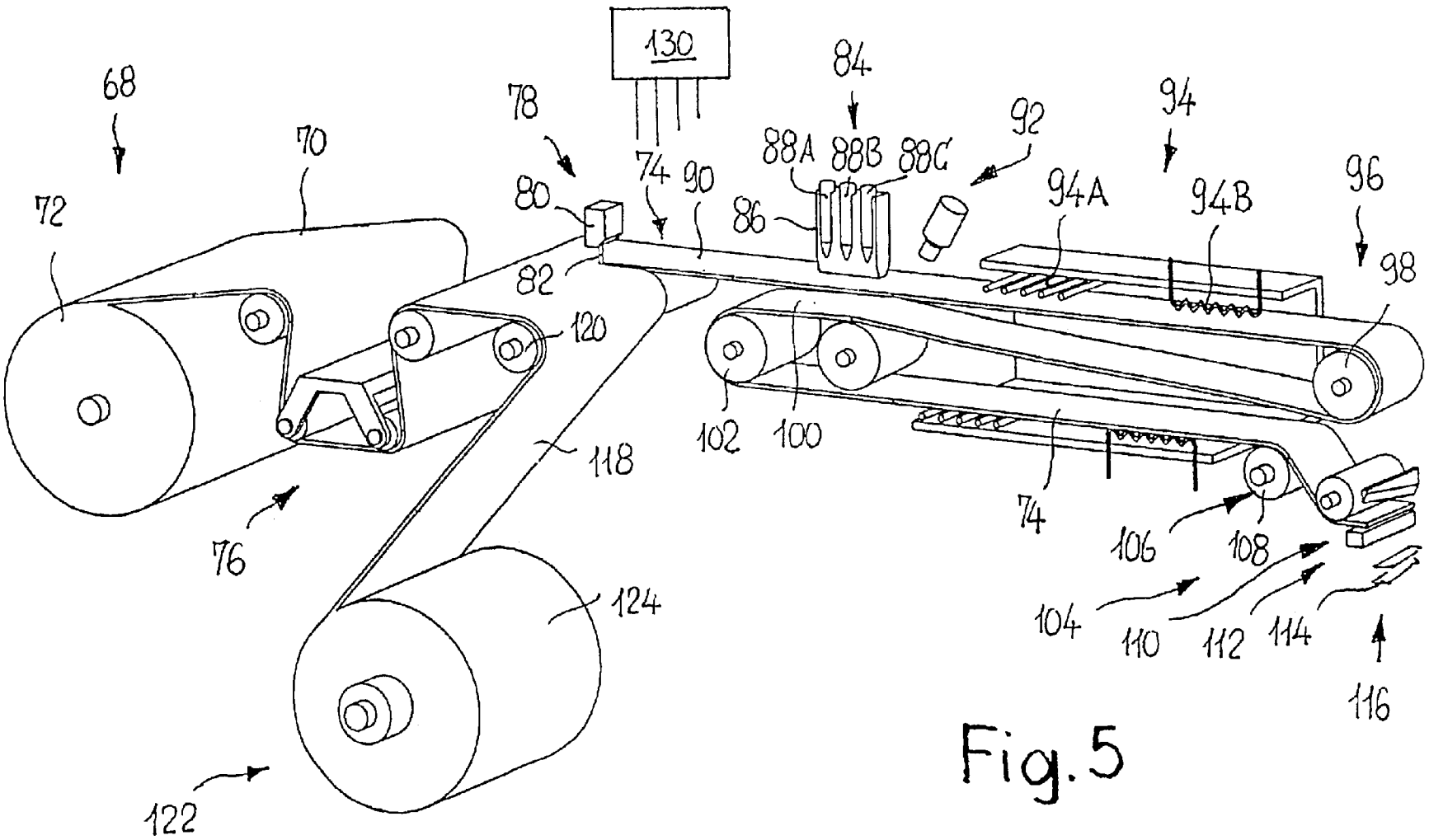
FIG. 5 shows a side view of a further plant for the continuous production of a printed textile tape, in particular a label tape, from a textile web of larger width.

FIG. 5 shows a further exemplary embodiment of a plant for the continuous production of a printed textile tape, in particular a label tape. This plant has a delivery device 68 for a textile web 70 which is wound on a stock roll 72. The width of the textile web 70 amounts to a multiple of the width of the printed textile tape 74. The textile web 70, coming from the stock roll 72, runs through a straightening device 76 and then arrives at the longitudinal-cutting station 78, at which a cutting element 80 in the form of a fuse wire 82 separates a textile tape 74 of the desired width from the textile web 70. The textile tape 74 then arrives at the printing station 84, at which a printing head 86 has printing units 88A, 88B, 88C arranged one behind the other for different colors. In this case, too, this is an ink-jet printer which first prints the first tape side 90 of the textile tape 74. The printing station is followed by a check sensor 92 which monitors the printing image for faults.

The printing station 84 and the check sensor 92 are followed by a fixing station 94 which has a UV region 94A and an IR region 94B. In the UV region 94A, the print is treated by UV light, for example polymerized. Fixing by means of heat treatment takes place in the IR region 94B. The fixing station 94 is followed by a turning station 96 which contains a deflecting roller 98 which is arranged transversely to the longitudinal direction of the textile tape and which leads the textile tape 74 back to the printing station 84. The textile tape 74 passes with its second tape side 100 under the printing head 86 of the printing station 84, travels through the latter in the opposite direction to the first tape side 90 of the textile tape 74 and is thus printed in a phase-shifted manner in the same operation and with the same printing station 84 by means of the same printing head 86. The textile tape 74, then printed on two sides, passes over a further deflecting roller 102 into the fixing station 94 and subsequently arrives at a draw-off device 104 which may be designed at the same time as a further tape fixing station 106. For this purpose, a roller 108 is heated. The tape fixing station 106 is followed by a cross-cutting station 110, at which the printed tape is cut by means of a cutting device 112, transversely to the running direction, into textile tape portions 114, preferably labels, which are stacked in a stacking device 116.

The textile web part 118 not used is supplied via a deflecting roller 120 to a reception device 122 and is preferably wound up into a stock roll 124.

Figure 6:
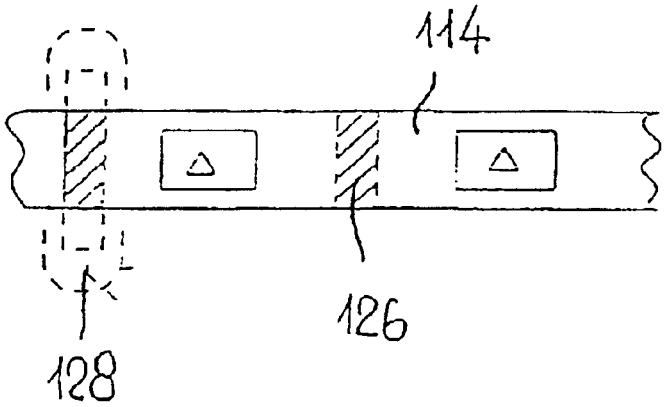
FIG. 6 shows a plan view of a detail of a printed textile tape.

FIG. 6 shows successive printed textile web portions 114 which are separated from one another by a separation region 126. At this separation region 126, all the nozzles of the printing head 86 operate simultaneously in order to clean these. A suction-extraction device 128, indicated by dashes and dots, discharges superfluous printing ink which is released.

The plant of FIG. 5 again contains an electronic control device 130 which controls not only the printing station 84, but all the components of the plant, and coordinates their functions with one another.

Figure 7:
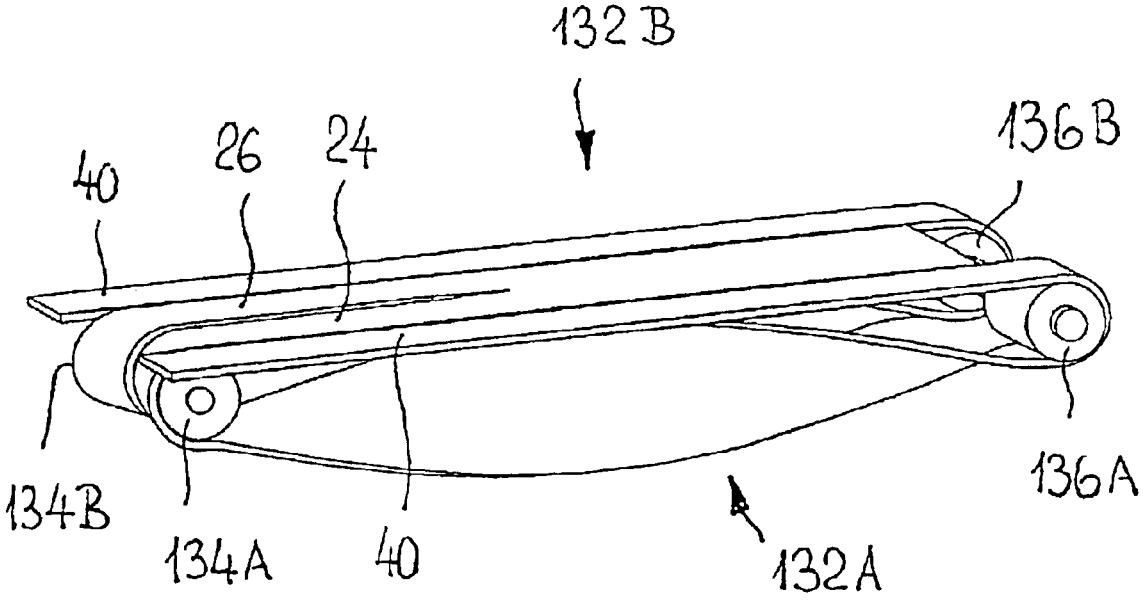
FIG. 7 shows a diagrammatic illustration of a detail of the plant of FIGS. 1 to 3 with modified turning station.

FIG. 7 shows a detail of the plant of FIGS. 1 to 3 with modified turning stations 132A, 132B. The textile tapes 24, 26 are led over first deflecting rollers 134A, 134B which are inclined at a small angle to the transverse direction of the textile tapes and thereby deflect the textile tapes 24, 26 from the original oncoming direction until they reach second deflecting rollers 136A, 136B outside the original oncoming direction of the textile tapes. Said second deflecting rollers are arranged in a similar way at an inclination such that the textile tapes 24, 26 are again deflected and oriented parallel to and in the running direction of the original oncoming textile tapes. Between the first deflecting rollers 134A, 134B and the second deflecting rollers 136A, 136B, the textile tapes are twisted about their longitudinal axis, so that, downstream of the second deflecting rollers 136A, 136B, they lie with their second tape side 40 on top.

Instead of or in addition to the straightening device, the plant may be equipped, upstream of the printing station, with a sensor which senses the edge of the textile tape, in order to determine the position of the edge and accordingly determine the lateral print start on the textile tape. The print start in the longitudinal direction of the textile tape may be determined by means of markings in the textile tape, particularly when the textile tape is not neutral, but is already provided with a, for example, woven-in ground pattern.

Numerous further exemplary embodiments may be envisaged, and, in particular, part versions of the exemplary embodiments may also be combined with one another.

LIST OF REFERENCE SYMBOLS

| | |
|---|---|
| 2 | Delivery device |
| 4 | Shaft |
| 6 | Stock roll |
| 8 | Textile web |
| 10 | Straightening device |
| 12 | Printing station |
| 14 | Roller |
| 16 | Roller |
| 18 | Longitudinal-cutting station |
| 20 | Cutting element |
| 22 | Fuse wire |
| 24 | Textile tape |
| 24A | Textile tape |
| 24B | Textile tape |
| 24C | Textile tape |
| 26 | Textile tape |
| 26A | Textile tape |
| 26B | Textile tape |
| 27 | First tape side |
| 28 | Printing head |
| 29 | Bearer |
| 30 | Fixing station |
| 32A | Deflecting roller |
| 32B | Deflecting roller |
| 34A | Turning station |
| 34B | Turning station |
| 36 | Turning member |
| 38 | Turning member |
| 40 | Second tape side |
| 42 | Longitudinal-cutting station |
| 44 | Cross-cutting station |
| 46 | Textile tape portion |
| 48 | Stacking device |
| 50 | Cutting knife |
| 52 | Longitudinal cutting station |
| 54 | Folding station |
| 56 | Edge region |
| 58 | Tape fixing station |
| 60 | Heating roller |
| 62 | Press roller |
| 64 | Textile tape portion |
| 66 | Control device |
| 68 | Delivery device |
| 70 | Textile web |
| 72 | Stock roll |
| 74 | Textile tape |
| 76 | Straightening device |
| 78 | Longitudinal cutting station |
| 80 | Cutting element |
| 82 | Fuse wire |
| 84 | Printing station |
| 86 | Printing head |
| 88A | Printing unit |
| 88B | Printing unit |
| 88C | Printing unit |
| 90 | First tape side |
| 92 | Check sensor |
| 94 | Fixing station |
| 94A | UV region |
| 94B | IR region |
| 96 | Turning station |
| 98 | Deflecting roller |
| 100 | Second tape side |

-continued

| LIST OF REFERENCE SYMBOLS | |
|---|---|
| 102 | Deflecting roller |
| 104 | Draw-off device |
| 106 | Tape fixing station |
| 108 | Roller |
| 110 | Cross-cutting station |
| 112 | Cutting device |
| 114 | Textile tape portions |
| 116 | Tacking device |
| 118 | Textile web part |
| 120 | Deflecting roller |
| 122 | Reception device |
| 124 | Stock roll |
| 125 | Print |
| 126 | Separation region |
| 128 | Suction-extraction device |
| 130 | Control device |
| 132A | Turning station |
| 132B | Turning station |
| 134A | First deflecting roller |
| 134B | First deflecting roller |
| 166A | Second deflecting roller |
| 136B | Second deflecting roller |

What is claimed is:

1. A plant for the continuous production of a printed textile tape, in particular a label tape, with a printing station connected to an electronic control device and having a printing head, characterized in that the plant is designed in such a way that the printing head prints a first tape side of the textile tape and selectively, in addition, a second tape side of the textile tape in one operation by means of the same printing head and with the same printing side as the first tape, the printing station being designed as an ink-jet printer with a printing head designed to move back and forth transversely over the textile tape.

2. The plant as claimed in claim 1, characterized in that the printing head is assigned a check sensor.

3. The plant as claimed in claim 1, characterized in that the first and second tape sides of the textile tape can be printed in a phase-shifted manner.

4. The plant as claimed in claim 1, characterized in that the first tape side of the textile tape is moveable past the printing head in a first running direction and the second tape side of the textile tape can be moved past the printing head in the same first running direction.

5. The plant as claimed in claim 1, characterized in that the first tape side of the textile tape is moveable past the printing head in a first running direction and the second tape side of the textile tape can be moved past the printing head in a second running direction, the second running direction being opposite the first running direction.

6. The plant as claimed in claim 1, characterized in that it has a turning station for turning the tape side of the textile tape with respect to the printing head.

7. The plant as claimed in claim 6, characterized in that the turning station has a device for turning the textile tape about its longitudinal axis.

8. The plant as claimed in claim 6, characterized in that it has a turning station for turning the textile tape transverse to its running direction.

9. The plant as claimed in claim 8, characterized in that the turning station has a turning member which is arranged transversely to the running direction and which supplies the textile tape with its second tape side to the printing head of the printing station.

10. The plant as claimed in claim 8, characterized in that the turning station has turning members which are arranged crosswise.

11. The plant as claimed in claim 1, characterized in that the ink-jet printer is designed for the processing of water-based printing ink.

12. The plant as claimed in claim 1, characterized in that the ink-jet printer is designed for the processing of printing ink polymerizing by UV light.

13. The plant as claimed in claim 1, characterized in that the printing station is designed as a multicolor printer and has preferably a plurality of printing units arranged one behind the other for different colors.

14. The plant as claimed in claim 1, characterized in that it has at least one fixing station for the print, which follows the printing station and which is based on UV light.

15. The plant as claimed in claim 14, characterized in that it has, downstream of the print fixing station, a press station for the textile tape.

16. The plant as claimed in claim 1, characterized in that it has a tape fixing station for the printed textile tape.

17. The plant as claimed in claim 1, characterized in that it has a coating station following the printing station, in order to provide the printed textile tape with a protective layer.

18. The plant as claimed in claim 1, characterized in that it has a delivery device for a textile web, the width of which corresponds at least to double the width of the textile tape to be printed, a longitudinal-cutting station being arranged upstream of the printing station, in order to cut off a textile tape to be printed from the textile web.

19. The plant as claimed in claim 18, characterized in that the textile web has essentially double the width of a textile tape to be printed, in order to cut the textile web into two identical textile tapes of the longitudinal-cutting station, the printing station having, downstream of the longitudinal-cutting station, devices which are duplicated mirror-symmetrically with respect to a vertical plane passing through the cutting line of the textile web.

20. The plant as claimed in claim 19, characterized in that a textile tape to be printed can be cut off at the longitudinal-cutting station from the textile web to be supplied, and the remaining residue of the textile web can be supplied via a deflecting device to a reception device, preferably a reception roll.

21. The plant as claimed in claim 1, characterized in that the printing station is designed in such a way that at least two longitudinal strips can be printed on the textile tape, the printing station being followed by a longitudinal-cutting station, in order to cut the textile tape into textile tapes corresponding to the printed longitudinal strips.

22. The plant as claimed in claim 1, characterized in that it has a folding station, in order to fold the edge regions of the printed textile tape against one another; the folding station preferably being followed by a tape fixing station.

23. The plant as claimed in claim 1, characterized in that it has a cross-cutting station, in order to subdivide the printed textile tape into portions, the cross-cutting station preferably being followed by a stacking device.

* * * * *